US006640919B1

(12) United States Patent
Towler

(10) Patent No.: US 6,640,919 B1
(45) Date of Patent: Nov. 4, 2003

(54) MOTORIZED DEVICE FOR PULLING A SKATER

(76) Inventor: George Antony Towler, 58 Portman Street, Zetland. NSW 2017 (AU)

( * ) Notice: Subject to any disclaimer, the term of this patent is extended or adjusted under 35 U.S.C. 154(b) by 0 days.

(21) Appl. No.: 09/914,334

(22) PCT Filed: Feb. 24, 2000

(86) PCT No.: PCT/AU00/00131

§ 371 (c)(1),
(2), (4) Date: Aug. 24, 2001

(87) PCT Pub. No.: WO00/50131

PCT Pub. Date: Aug. 31, 2000

(51) Int. Cl.[7] ..... A63C 5/08
(52) U.S. Cl. ..... 180/181; 180/180; 180/19.1
(58) Field of Search ..... 180/180, 181, 180/183, 186, 185, 19.1, 19.2, 19.3, 11, 11.5, 14.1, 14.2, 191, 65.1; 280/826; 16/35 R

(56) References Cited

U.S. PATENT DOCUMENTS

| | | | | | |
|---|---|---|---|---|---|
| 3,515,313 | A | * | 6/1970 | Siems | 180/19.3 |
| 3,797,446 | A | * | 3/1974 | Cox et al. | 180/19.1 |
| 4,165,093 | A | * | 8/1979 | Biskup | 280/220 |
| 4,456,089 | A | * | 6/1984 | Kuwahara | 180/180 |
| 4,878,554 | A | * | 11/1989 | Dion | 180/19.3 |
| 5,039,121 | A | * | 8/1991 | Holter | 280/220 |
| 5,385,210 | A | * | 1/1995 | Harvey | 180/180 |
| 5,562,176 | A | * | 10/1996 | Lucernoni et al. | 180/180 |
| 5,735,361 | A | * | 4/1998 | Forrest | 180/180 |
| 5,899,474 | A | * | 5/1999 | Grutzik | 280/87.041 |
| 5,938,240 | A | * | 8/1999 | Gairdner | 280/11.212 |
| 6,163,924 | A | * | 12/2000 | Ward et al. | 16/35 R |
| 6,415,880 | B1 | * | 7/2002 | Strothmann | 180/19.3 |

FOREIGN PATENT DOCUMENTS

| | | | | |
|---|---|---|---|---|
| DE | 3443164 A1 | * | 6/1985 | B62D/59/04 |
| FR | 2565118 | * | 12/1985 | A63C/17/26 |
| GB | 2246751 | | 2/1992 | |
| WO | WO97/12651 | | 4/1997 | |

* cited by examiner

*Primary Examiner*—Brian L. Johnson
*Assistant Examiner*—Hau Phan
(74) *Attorney, Agent, or Firm*—Jordan and Hamburg LLP

(57) ABSTRACT

A device for pulling a skater including a longitudinal frame, handle bars provided at the upper end potion of the frame and a ground engaging drive wheel rotatably coupled to a lower end portion of the frame. A prime mover is mounted on the frame so as to drive the drive wheel, and a unit for controlling a rotational speed of the drive wheel is coupled thereto. An arm having at least one ground engaging jockey wheel is rotatably coupled to one end thereof and in movably connected at its opposite end to the frame in such a manner that the jockey wheel is disposed substantially rearwardly of the drive wheel when the device is in use.

24 Claims, 4 Drawing Sheets

MOTORIZED DEVICE FOR PULLING A SKATER

TECHNICAL FIELD

The present invention relates to a motorised device for pulling or towing a wheeled user, and in particular to a motorised device for pulling a skater wearing roller skates, in-line skates or the like.

BACKGROUND

Motorised devices for towing or pushing a skater are known in the art. The advent of these devices is due to the increased popularity in recent years of in-line skating, roller skating and skateboarding. A number of patents disclose such devices.

U.S. Pat. No. 3,797,446 (Cox et al.) discloses a motorised device for propelling a skater from the rear, as does WO 97/12651 (Rosenwald). Both these devices comprise a frame supporting a drive wheel. A driving means is affixed to the frame for propelling the drive wheel. In use, the skater holds handles affixed to the frame with the drive wheel positioned behind the skater. By actuating control means which control the drive means and therefore propulsion of the drive wheel, the skater is propelled in a forward direction.

U.S. Pat. No. 4,456,089 (Kuwahara) discloses a motorised vehicle which can be used to either push or pull a skater. The vehicle comprises a frame, a handle provided at the upper portion of the frame, a wheel provided at the lower end of the frame and a prime mover mounted on the frame so as to drive the wheel. The handle is provided with control means for controlling the operational speed of the prime mover and for braking the wheel.

U.S. Pat. No. 5,385,210 (Harvey) discloses a motorised tow vehicle system for towing or pulling a skater. The system comprises a frame (or chassis) having adjustable handle bars projecting therefrom. A drive wheel driven by an electric motor is mounted to the frame.

A problem associated with the above referenced prior art devices, is that they are difficult for most skaters to steer as they are propelled forward. Whilst most of devices work satisfactorily while the skater is being propelled forwards in a straight line at low speeds, they are difficult to use when attempting to effect a turn whilst being pulled or towed.

The present invention seeks to provide a motorised device for pulling a skater with improved steering capability.

It should be understood that throughout the specification the word "skater" is used to refer to a wheeled user such as a person wearing roller skates, in-line skates or the like, or a person riding a skate board.

SUMMARY OF INVENTION

In one aspect the present invention consists in a device for pulling a skater comprising a longitudinal extending frame, handle bars provided at the upper end portion of said frame, a ground engaging drive wheel rotatably coupled to a lower end portion of said frame, a prime mover mounted on said frame so as to drive said drive wheel, and means for controlling a rotational speed of said drive wheel coupled thereto, characterised in that an arm having at least one ground engaging jockey wheel rotatably coupled to one end thereof is movably connected at its opposite end to said frame in such a manner that said jockey wheel is disposed substantially rearwardly of said drive wheel when said device is in use.

Preferably the movable connection of said arm to said frame is a pivotal connection.

Preferably the pivotal connection is at a location on said frame disposed between said handle bars and said drive wheel.

Preferably said arm is adapted to be releasably secured by a means of securing to prevent pivotal rotation thereof with respect to said frame.

Preferably said arm is adapted for 360 degree rotation about said frame.

Preferably said at least one jockey wheel has an axis of rotation which is pivotable with respect to said arm.

Preferably said at least one jockey wheel is coupled to said arm via a support member.

Preferably said axis of rotation of said jockey wheel is fixed with respect to said support member.

Preferably said support member is pivotally connected to said arm.

Preferably said support member is adapted to be releasably secured by a means of securing to prevent pivotal rotation thereof with respect to said arm.

Preferably said prime mover is a battery-powered electric motor.

BRIEF DESCRIPTION OF THE DRAWINGS

By way of non-limiting example, an embodiment of the above mentioned invention is described hereafter with reference to the accompanying drawings.

MODE OF CARRYING OUT INVENTION

Figure 1:
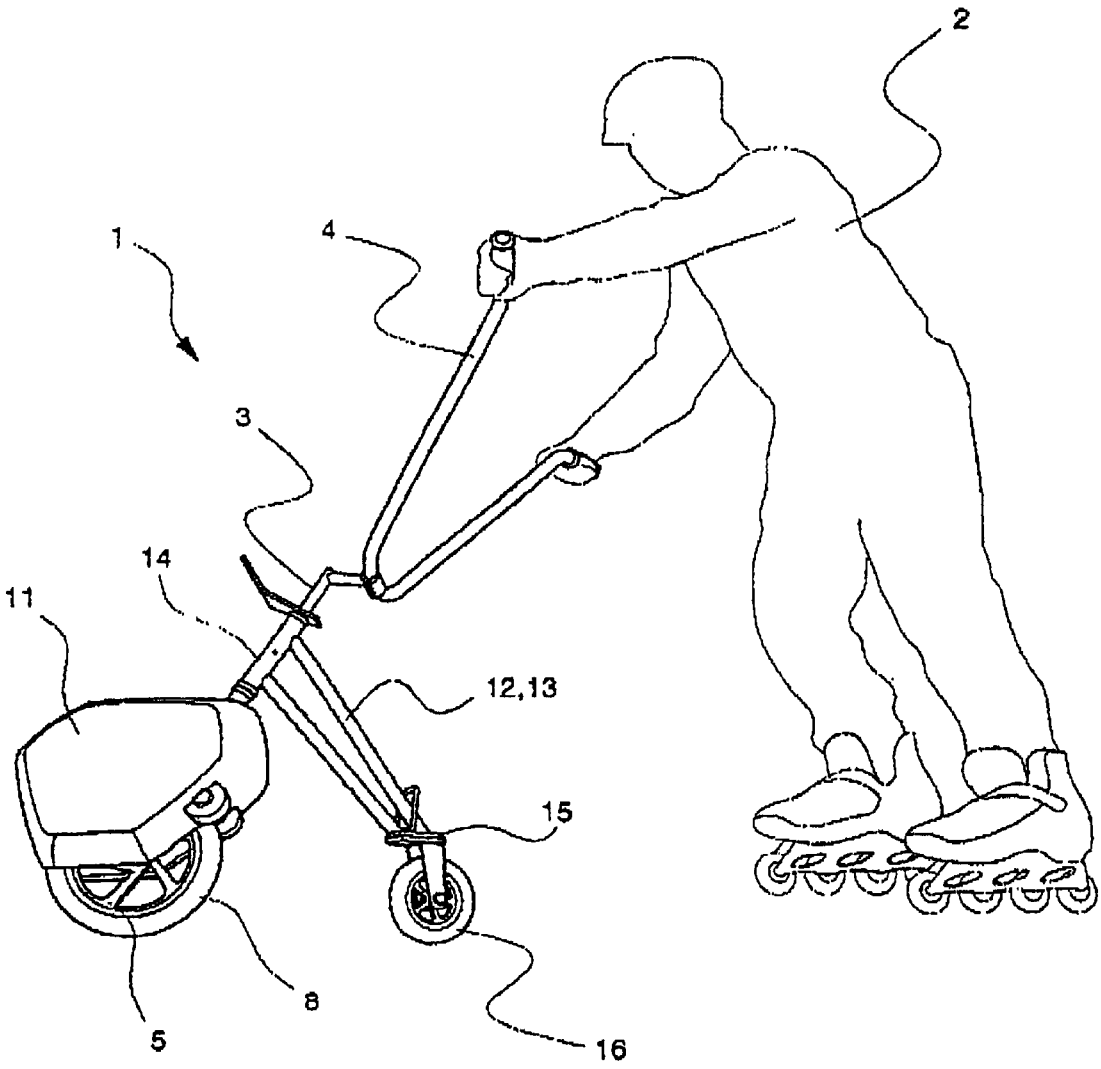
FIG. 1 is a perspective view of one embodiment of the device for pulling a skater being operationally used by a skater.

FIGS. 1 to 8 depict an embodiment of a device 1 for pulling or towing a skater 2. The device 1 comprises a longitudinal extending frame 3, handle bars 4 provided at the upper end portion of frame 3, and a ground engaging drive wheel 5 rotatably mounted at the lower end portion of frame 3. The drive wheel 5 preferably comprises a pneumatic tyre 8.

Figure 5:
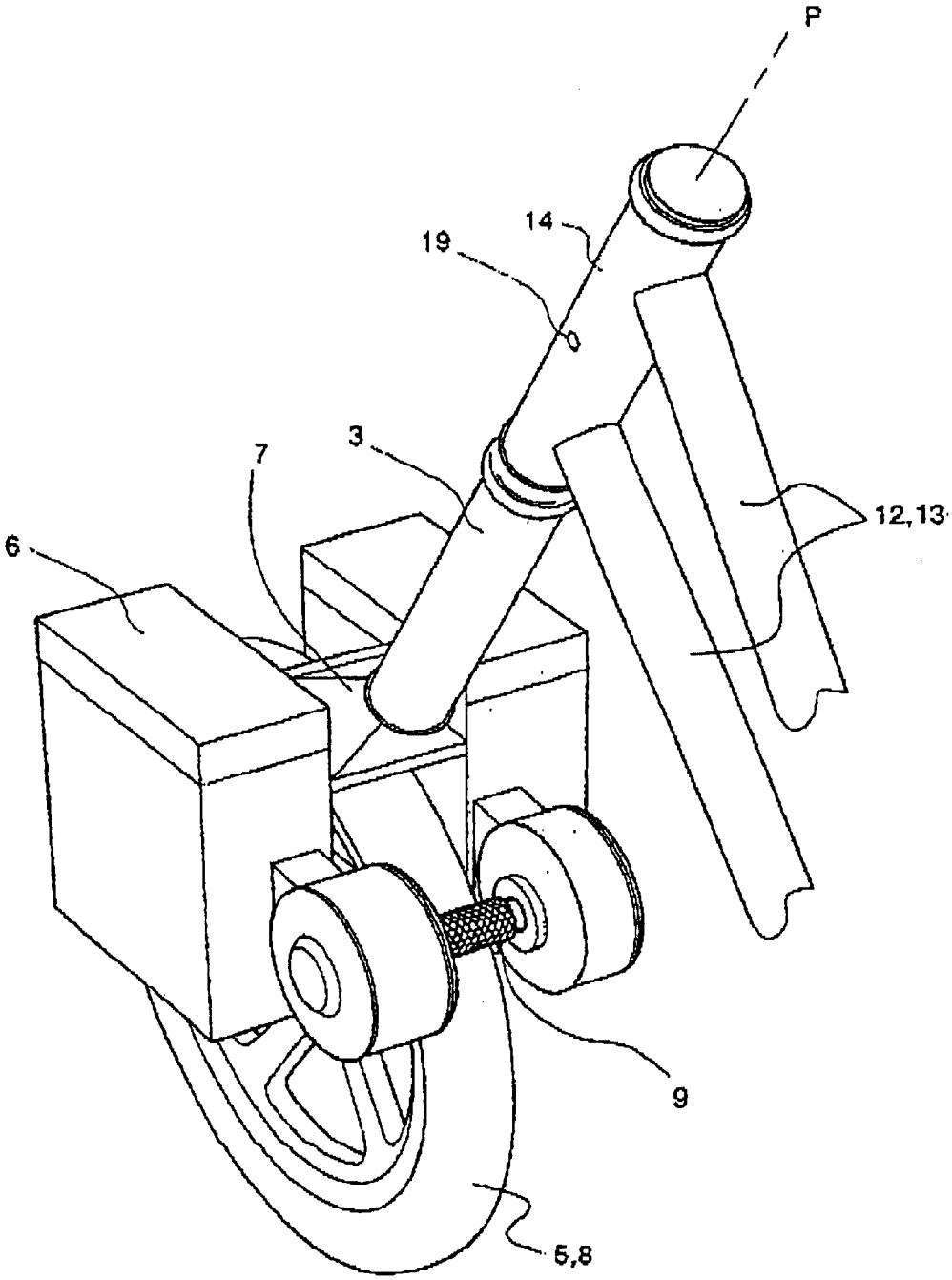
FIG. 5 is a rear perspective view of the drive wheel/prime mover of the device shown in FIG. 1.
Figure 6:
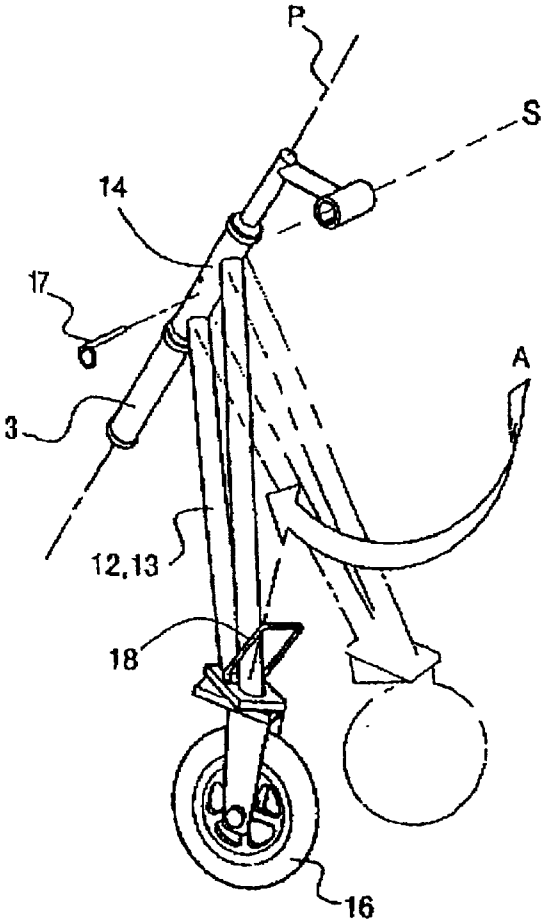
FIGS. 6–8 are rear perspective views of the arm/jockey wheel of the device shown in FIG. 1.

As shown in FIG. 5, a prime mover 6, which in this embodiment is a rechargeable battery-powered electric motor, is mounted via a sub-frame 7 to frame 3. The prime mover 6 comprises a drive means in the form of driven roller 9 adapted to engagably contact the pneumatic tyre 8 of drive wheel 5. In use, as the prime mover 6 rotates driven roller 9, the drive wheel 5 is rotated thereby propelling the device in a forward direction. The driven roller 9, preferably has a knurled surface or other non-uniform surface to minimise slippage occurring between roller 9 and drive wheel 5. A removable cover 11, which covers prime mover 6 as shown in FIG. 1, is removed in FIG. 5.

The handle bars 4, are provided with controls for controlling the rotational speed of device 1. The rotatonal speed is controlled by an accelerator trigger/actuator 10 mounted on handle bars 4 and operably coupled to prime mover 6. Device 1, may also be provided with a separate hand actuated braking device (not shown) which acts on drive wheel 5 independent of driven roller 9, in a like manner to those provided on bicycles and scooters.

An arm 12, comprising two elongate tubes 13 interconnected by joint tube 14 is pivotally connected to frame 3 about axis P. A support member 15 is pivotally connected at the opposite end of arm 12 about axis Q. Jockey wheel 16 is rotatably coupled to support member 15.

Figure 4:
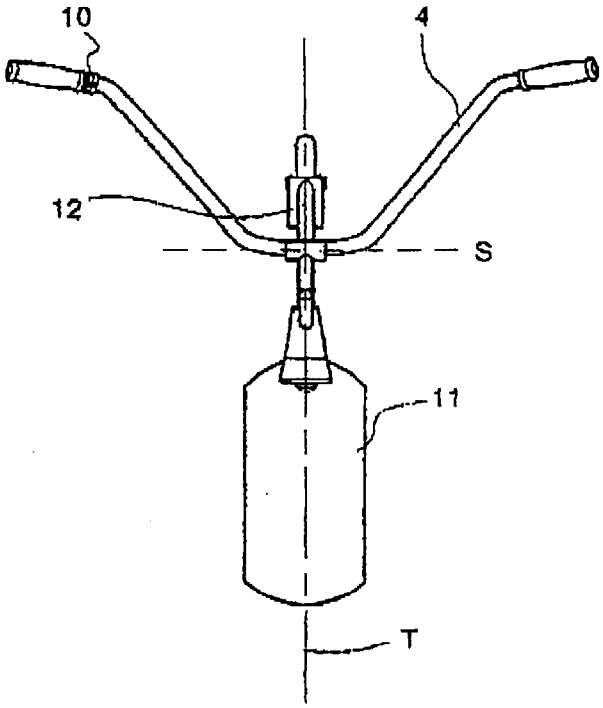
FIG. 4 is a plan view of the device shown in FIG. 1.
Figure 3:
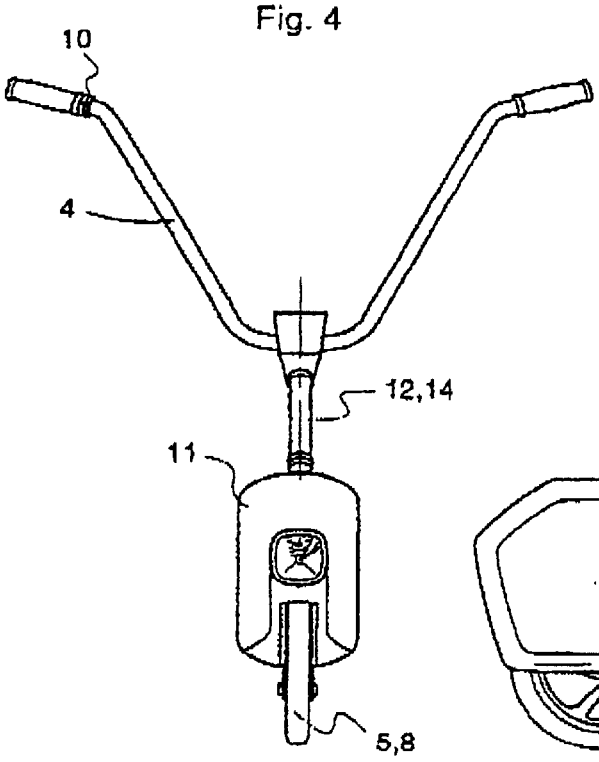
FIG. 3 is a front end view of the device shown in FIG. 1.
Figure 2:
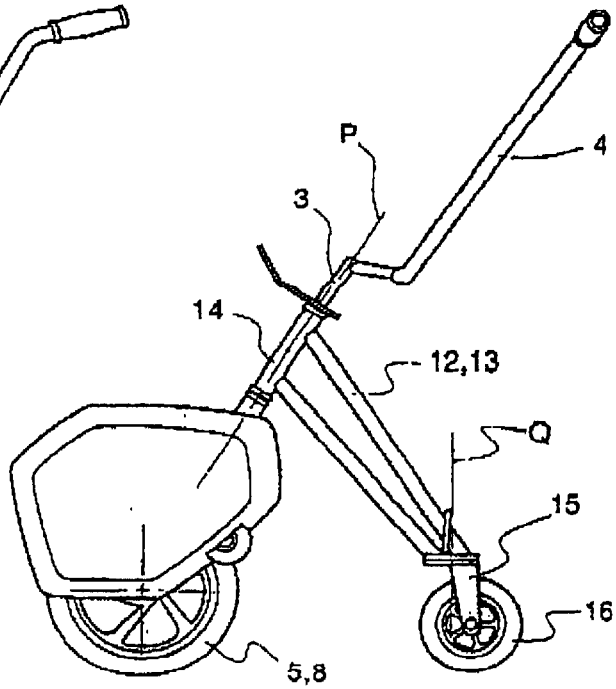
FIG. 2 is an elevational view of the device shown in FIG. 1.

A pin 17 is adapted to pass through apertures 19 in arm 12 and frame 3, to releasably secure and prevent pivotal rotation of arm 12 about axis P with respect to frame 3. The pivotal rotation of arm 12 with respect to frame 3 is depicted by arrow A in FIG. 6. The device 1 may be operated by a skater either with or without pivotal rotation of the arm 12 with respect to frame 3. When in a secured configuration arm 12 is secured in a central orientation along the line of travel T of drive wheel 5 as shown in FIG. 4.

Figure 7:
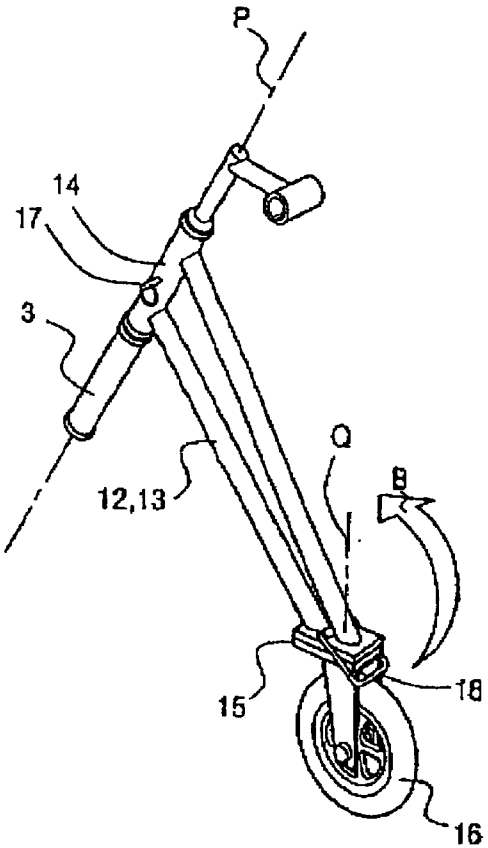
Figure 8:
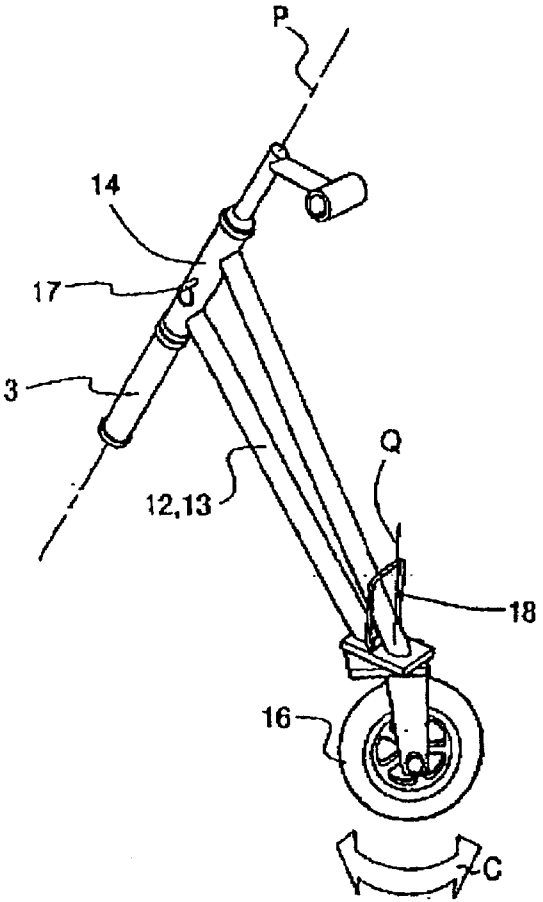

A hinged securing device 18, in the shape of a U-shaped bar, is adapted to releasably secure and prevent pivotal rotation of the support member 15 about axis Q with respect to arm 12. The device may be operated either with or without pivotal rotation of the support member 15 with respect to arm 12. FIG. 7 depicts the configuration in which securing device 18 is secured, thereby preventing support member 15 from rotating about axis Q. When in this secured configuration the jockey wheel 16 is in a plane parallel to that of arm 12. By pivotally lifting hinged securing device 18 in the direction shown by arrow B in FIG. 7, the support member 15 is free to rotate about axis Q. The pivotal rotation of support member 15 and jockey wheel 16 with respect to arm 12 is depicted by arrow C in FIG. 8.

The provision of the pivotal arm 12 and pivotal jockey wheel 16 improve the steering and handling capabilities of device 1. When a skater intends using device 1 in a situation where very little turning will be involved or the turns will be gentle ie. with a large radius of turn, device 1 can be operated with arm 12 in a secured configuration with respect to frame 3 by means of pin 17. In a situation where the skater intends to operate device 1 where weaving and short turns are desired, the user may remove locking pin 17, and allow arm 12 to pivot about axis P with respect to frame 3 as device 1 is operated.

The pivotal nature of arm 12 with respect to frame 3 significantly improves the ease of handling device 1 by the skater, where weaving and tight turns are being effected. This is achieved by allowing arm 12 to swing from side to side about axis P, as jockey wheel 16 trails behind drive wheel 5. This allows device 1 to be more easily and enjoyably used for both transportation and pastime purposes.

The provision of releasably securing jockey wheel 16 and support member 15 for rotation about axis Q, is to allow flexibility in the steering and handling characteristics of device 1. Some skaters may prefer to have the support member 15 secured to prevent movement of jockey wheel 16 about axis Q, whilst others may prefer support member 15 and jockey wheel 16 to be free to rotate about axis Q when device 1 is being operated. In use, when arm 12 is allowed to rotate about axis P and jockey wheel 16 is allowed to rotate about axis Q, the steering and handling characteristics of device 1 are maximised.

Arm 12 is free to rotate 360 degrees about axis P. This not only allows arm 12 and jockey wheel 18 to swing from side to side as device 1 is being operated, it also allows for arm 12 to be swung around through 180 degrees when the device 1 is not in use. In addition to pivoting the arm 12, handle bars 4 are adjustably pivotal about axis S, thereby reducing the storage space necessary when device 1 is not in use. It is also preferable that prime mover 6 and driven roller 9 be able to be releasably secured to frame 3, in order to provide an ease of storage of device 1. The detachable nature of prime mover 6 from frame 1, also allows for device 1 to be used as a training aid for inexperienced skaters, prior to device 1 being fitted with prime mover 6 for motorised use.

Whilst in the present embodiment arm 12 is able to rotate about axis P, it should be understood that in other not shown embodiments arm 12 may have a further degree of freedom, by providing a ball and socket or universal joint with frame 3, thereby allowing arm 12 and jockey wheel 16 to move up and down as device 1 is operated. This would allow jockey wheel 16 to rise and fall as uneven ground is being traversed when device 1 is being operated.

It should also be understood that in other not shown embodiments, the jockey wheel arrangement may differ in configuration. For instance, the single jockey wheel 16 of the above described embodiment may be replaced by a pair of side-by-side jockey wheels both mounted to support member 15 and sharing a common axis of rotation.

Whilst in tis present embodiment a rechargeable battery-powered electric motor is described as prime mover 6, it should be understood that other suitable prime movers, such as a gasoline engine could be used in other embodiments. Likewise whilst in the present embodiment the drive means which interconnects the prime mover 6 and drive wheel 5 is driven roller 9, it should be understood that in other not shown embodiments, the drive means may incorporate a conventional belt or chain drive as used on motorcycles. In a further not shown embodiment, the prime mover/drive means may be a hub-mounted battery-powered electric motor fitted to the drive wheel 5. Also in a further not shown embodiment the drive means may be provided with a number of forward gear ratios and at least one reverse gear.

It should also be understood that the shape and configuration of various components, such as arm 12, locking pin 17, hinge securing device 18, drive wheel 5, jockey wheel 16 and support member 15, may differ in shape and configuration without departing from the scope and spirit of the invention.

What is claimed is:

1. A device for pulling a skater comprising:

a longitudinal extending frame having an upper end portion and a lower end portion, and defining a steering axis, handle bars provided at the upper end portion of said frame, a ground engaging drive wheel rotatably coupled to the handle bars of said frame and tiltable about said steering axis of said frame by operation of the handle bars, a prime mover mounted on said frame so as to drive said drive wheel, means for controlling a rotational speed of said drive wheel, and an arm having at least one ground engaging jockey wheel rotatably coupled to one end of said arm, and said arm being movably connected at another end of said arm to said frame in such a manner that said jockey wheel is disposed substantially rearwardly of the drive wheel when the device is in use and said arm is rotatable about said axis of said frame.

2. A device for pulling a skater as claimed in claim 1, wherein the movable connection of the arm to the frame is a pivotal connection.

3. A device for pulling a skater as claimed in claim 2, wherein the pivotal connection is at a location on the frame disposed between said handle bars and said drive wheel.

4. A device for pulling a skater as claimed in claim 2, wherein the arm is adapted to be releasably secured by a first means of securing to prevent pivotal rotation thereof with respect to the frame.

5. A device for pulling a skater as claimed in claim 2, wherein the arm is adapted for 360 degree pivotal rotation about the frame.

6. A device for pulling a skater as claimed in claim 1, wherein said at least one jockey wheel has an axis of steering rotation which is pivotable with respect to said arm.

7. A device for pulling a skater as claimed in claim 1, wherein said at least one jockey wheel is coupled to said arm via a support member.

8. A device for pulling a skater as claimed in claim 7, wherein the axis of rotation of said jockey wheel is fixed with respect to said support member.

9. A device for pulling a skater as claimed in claim 8, wherein the support member is pivotally connected to said arm.

10. A device for pulling a skater as claimed in claim 9, wherein the support member is adapted to be releasably secured by a second means of securing to prevent pivotal rotation thereof with respect to the arm.

11. A device for pulling a skater as claimed in claim 1, wherein said prime mover is a battery powered electric motor.

12. A device for pulling a skater as claimed in claim 1, wherein said prime mover is releasably secured to said frame.

13. A device for pulling a skater comprising:

a frame having a steering axis;

at least one steering member provided at an upper end portion of said frame;

a drive wheel tiltable about the steering axis of the frame such that a plane of the drive wheel tilts relative to the ground;

a first device driving said drive wheel, said first device mounted to said frame to rotate about said steering axis to permit tilting of the drive wheel relative to the ground;

a second device controlling a rotational speed of said drive wheel;

an arm connected to a rearwardly disposed jockey wheel; and said arm being rotatable about the steering axis of the frame.

14. A device for pulling a skater as claimed in claim 13, wherein the arm is pivotably connected to the frame.

15. A device for pulling a skater as claimed in claim 14, wherein the arm is pivotably connected to the frame at a location between the at least one steering member and the drive wheel.

16. A device for pulling a skater as claimed, in claim 14, further comprising a third device for preventing pivotal rotation of the arm with respect to the frame.

17. A device for pulling a skater as claimed in claim 14, wherein the arm is adapted for 360 degree pivotal rotation about the frame.

18. A device for pulling a skater as claimed in claim 13, wherein said at least one jockey wheel has an axis of steering rotation which is pivotable with respect to said arm.

19. A device for pulling a skater as claimed in claim 13, wherein said at least one jockey wheel is coupled to said arm via a support member.

20. A device for pulling a skater as claimed in claim 19, wherein the axis of rotation of said jockey wheel is fixed with respect to said support member.

21. A device for pulling a skater as claimed in claim 20, wherein the support member is pivotally connected to said arm.

22. A device for pulling a skater as claimed in claim 21, wherein the support member is adapted to be releasably secured by a fourth device for preventing pivotal rotation thereof with respect to the arm.

23. A device for pulling a skater as claimed in claim 13, wherein said first device is a battery powered electric motor.

24. A device for pulling a skater as claimed in claim 13, wherein said first device is releasably secured to said frame.

* * * * *